US009561151B2

(12) United States Patent
Opsetmoen

(10) Patent No.: US 9,561,151 B2
(45) Date of Patent: Feb. 7, 2017

(54) SUPPORT AND SHOPPING WALKER

(71) Applicant: Anton Opsetmoen, Desert Hot Springs, CA (US)

(72) Inventor: Anton Opsetmoen, Desert Hot Springs, CA (US)

(73) Assignee: Jonathan Schwartz, Colfax, CA (US)

( * ) Notice: Subject to any disclaimer, the term of this patent is extended or adjusted under 35 U.S.C. 154(b) by 0 days.

(21) Appl. No.: 15/007,300

(22) Filed: Jan. 27, 2016

(65) Prior Publication Data

US 2016/0213550 A1 Jul. 28, 2016

Related U.S. Application Data

(60) Provisional application No. 62/108,174, filed on Jan. 27, 2015.

(51) Int. Cl.
*A61H 3/04* (2006.01)
*A45B 11/00* (2006.01)

(52) U.S. Cl.
CPC ..... *A61H 3/04* (2013.01); *A45B 11/00* (2013.01); *A61H 2003/046* (2013.01)

(58) Field of Classification Search
CPC ..... A61H 3/04; A47C 4/286; B62B 2205/06
USPC ..... 135/66; 280/642, 647, 649; 297/16.2
See application file for complete search history.

(56) References Cited

U.S. PATENT DOCUMENTS 3,136,272 A * 6/1964 Sprigman ..... A47C 4/286 108/118
6,354,619 B1 * 3/2002 Kim ..... B62B 3/106 280/649
6,598,898 B2 7/2003 Chu
6,729,342 B2 5/2004 Serhan
6,929,230 B2 * 8/2005 Tsai ..... B65F 1/1468 108/67
7,077,422 B2 * 7/2006 Haury ..... A61G 5/08 280/644
7,306,246 B2 12/2007 Gale
7,472,921 B2 * 1/2009 Harrison ..... A47C 4/286 280/647
7,562,930 B1 * 7/2009 Rondeau ..... A47C 7/66 297/184.16
7,631,654 B2 * 12/2009 Blumenthal ..... A45B 19/06 135/16

(Continued)

FOREIGN PATENT DOCUMENTS

DE 10138306 A1 * 3/2003 ..... B62B 1/208

*Primary Examiner* — Noah C Hawk
(74) *Attorney, Agent, or Firm* — Larry D. Johnson

(57) ABSTRACT

A collapsible support and shopping walker includes eight tubes of equal length that pivot in eight corner supports forming four cross braces. This four-sided cage can then flex in one direction from being fully collapsed to fully extended. Flexible fabric is attached across four corners to this cage allowing it to open about half-way between the collapsed state and full extension and can now be used as a seat. Collapsible diagonal supports, hinged at each end, form a "spider" which provides stability and enables easy opening and closing of the cage by moving the spider head up and down. In order to provide a stable chair or walker the spider must be lockable with the seat in the open position. This is arranged by letting the spider over toggle which stretches the fabric fully and tightens all the joints of the chair.

4 Claims, 3 Drawing Sheets

(56) References Cited

U.S. PATENT DOCUMENTS

| | | | | |
|---|---|---|---|---|
| 8,024,825 | B2 * | 9/2011 | Harrison | B62B 3/02 280/647 |
| 8,162,349 | B1 * | 4/2012 | Roselle | B62B 1/008 280/639 |
| 8,186,367 | B1 | 5/2012 | Le tran et al. | |
| 8,333,208 | B2 | 12/2012 | Troy | |
| 8,882,135 | B1 * | 11/2014 | Chen | B62B 3/02 280/651 |
| 9,073,564 | B2 * | 7/2015 | Yang | B62B 3/02 |
| 2003/0016991 | A1 * | 1/2003 | Zheng | A45B 11/00 403/287 |
| 2010/0026056 | A1 * | 2/2010 | Yul | A47C 4/286 297/16.2 |

* cited by examiner

SUPPORT AND SHOPPING WALKER

CROSS REFERENCE TO RELATED APPLICATIONS

The present application claims the benefit of the filing date of U.S. Provisional Patent Application Ser. No. 62/108,174, filed Jan. 27, 2015. The foregoing application is incorporated by reference in its entirety as if fully set forth herein.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to walkers and mobility assistance devices, and more particularly to an improved support and shopping walker.

BACKGROUND INFORMATION AND DISCUSSION OF RELATED ART

Known collapsible support walkers typically fold together in two dimensions, i.e., back to front or side to side. As a result, even in their collapsed configuration they are difficult to store and transport.

U.S. Pat. No. 6,598,898 to Chu discloses a foldable cart apparatus including a first, second and third U-shaped frames pivotally joined and functionally movable between a folded attitude and an unfolded attitude. Its primary function is for carrying articles such a beach related items. In the folded attitude the frames are positioned adjacently. In the unfolded attitude the first and second frames diverge upwardly and the second and third frames diverge downwardly as viewed from the side. The first frame is engaged with a bottom strut supported on spaced apart wheels for moving the apparatus on a surface. A flexible sling is engaged with the first and the third of the frames, so that in the unfolded attitude, a vertical rear containment wall and a horizontal bottom shelf are formed. A flexible fabric bag is fastened between the first and second of the frames and forms an open topped container for receiving the items for transport. The bottom shelf can be used to support an ice chest or other bulky article.

U.S. Pat. No. 6,729,342 to Serhan describes a foldable walker having a paddle shaped lever arranged to interact with locking pins by lateral movement in either direction. In a particular embodiment, the walker has at least two locking positions wherein the walker can hyper-extend, spreading out and locking to a more fully opened configuration, allowing the walker to be pulled closer to the patient making it easier for the patient to lift himself or herself up to a standing position.

U.S. Pat. No. 7,306,246 Gale teaches a walker apparatus comprised of a first front support leg assembly, a second front support leg assembly, a first sliding joint, a second sliding joint, a central hinge joint, a first rear support leg assembly, a second rear support leg assembly, a first support member, a second support member, a front leg collapsing assembly, and a rear leg collapsing assembly. The walker apparatus is adapted to be is collapsed to a compact shape in a continuous collapsing motion.

U.S. Pat. No. 8,186,367 to Le tran, et al. discloses a foldable walker including upstanding legs arranged in a generally square pattern, each of which is capped by a fixed joint member and each of which has a slider member slideably disposed on it. Two forward legs are interconnected by two rigid links arranged in a scissors arrangement with the uppermost end of each link pivotally connected to a fixed joint member and the lowermost end of each link pivotally connected to a slider. Each forward leg is interconnected to its associated rearward leg in the same way. Each pair of rigid links is interconnected to one another by a pivot pin. The linkage enables the width and the depth of the walker to be reduced to a very small space and telescoping legs reduce the height dimension of the walker. Handles are folded when the walker is stored and pivoted into their operable position when the walker is deployed.

U.S. Pat. No. 8,333,208 to Miller describes a collapsible walking device that can be disposed in an operative (open) configuration and a storage (closed) configuration. The open, operative configuration of the walking device provides a structure to aid a user in walking or standing. The closed, storage configuration allows for easy and convenient storage and transport of the walking device. The collapsible walking device can be transitioned from the operative configuration to the storage configuration in one motion. The walking device includes four support legs that extend to the ground from adjacent two handles.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an improved collapsible support and shopping walker based on the same structural principle used with four legged camping chairs. Eight lightweight tubes of equal length pivot in eight corner supports forming four cross braces. This four-sided arrangement or cage can then flex in one direction from being fully collapsed to fully extended. Flexible fabric is attached across four corners to this cage allowing it to open about half-way between the collapsed state and full extension. The suspended flexible fabric can now be used as a seat. Collapsible diagonal supports made of four aluminum members of equal length, hinged at each end, form an array or "spider" which provides stability and enables easy opening and closing of the cage by moving the spider head up and down like an umbrella. In order to provide a stable chair or walker the spider must be lockable with the seat in the open position. This is arranged by letting the spider over toggle or go over its opening tipping point which stretches the fabric fully and tightens all the joints of the chair.

The walker may include adjustable telescoping handles, walker type wheel brake grips and brakes, and swivel type casters in the front. Collapsible netting may be used to surround the seat transforming the walker into a small flexible collapsible shopping cart. The vertical tube of one walker handle can support an umbrella to serve as sun or rain cover.

It is therefore an object of the present invention to provide a new and improved walker having a unique support structure and arrangement.

A further object or feature of the present invention is a new and improved structure that transforms into a walker.

An even further object of the present invention is to provide a novel walker that expands into a shopping cart.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 2:
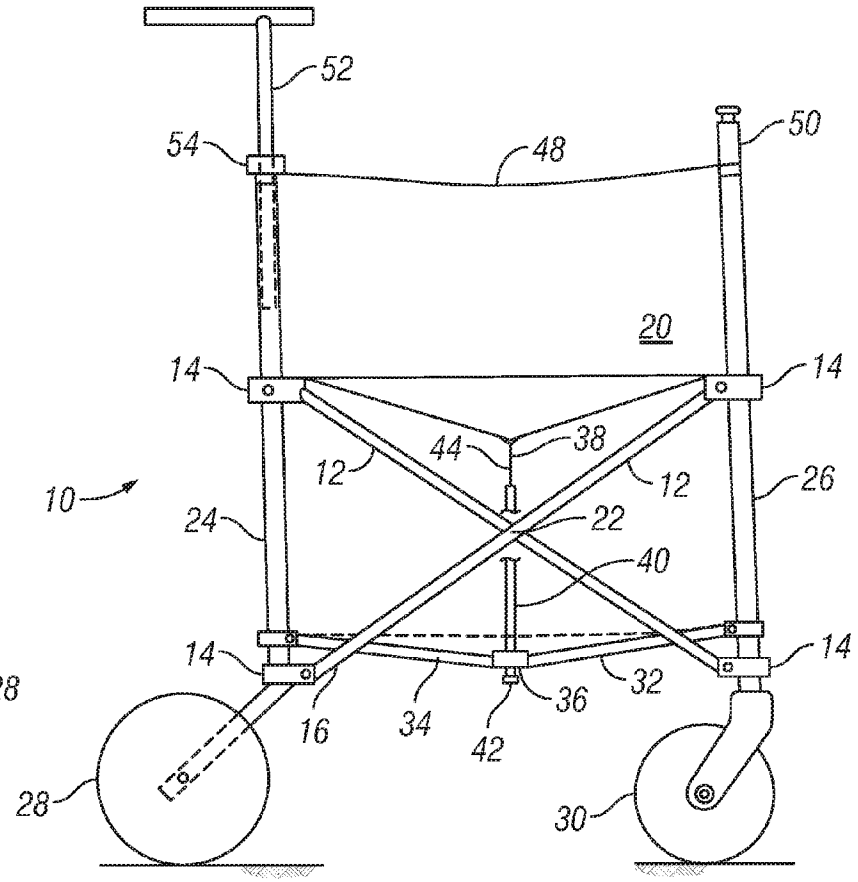
FIG. 2 is a side elevation view thereof.

Referring to FIGS. 1 through 6, wherein like reference numerals refer to like components in the various views, there is illustrated therein a new and improved support and shopping walker, generally denominated 10.

The support and shopping walker 10 of the present invention is based on the same structural principle used with four legged camping chairs. Eight lightweight tubes 12 of equal length pivot in eight corner supports 14 forming a "cage" of four cross braces 16. This four-sided arrangement or cage can then flex in one direction from being fully collapsed to fully extended.

In order to form a stable chair, flexible fabric 20 is attached across four corners to this cage allowing it to open about half-way between the collapsed state and full extension. The suspended flexible fabric 20 can now be used as a seat where the load is reflected as compression forces on the cross braces 16. On level ground this forms a firm support of the load.

To make this chair as light as possible the cross braces also include a pivot 22 where they intersect, allowing for higher compression forces, i.e. reducing tube size and weight.

Figure 1:
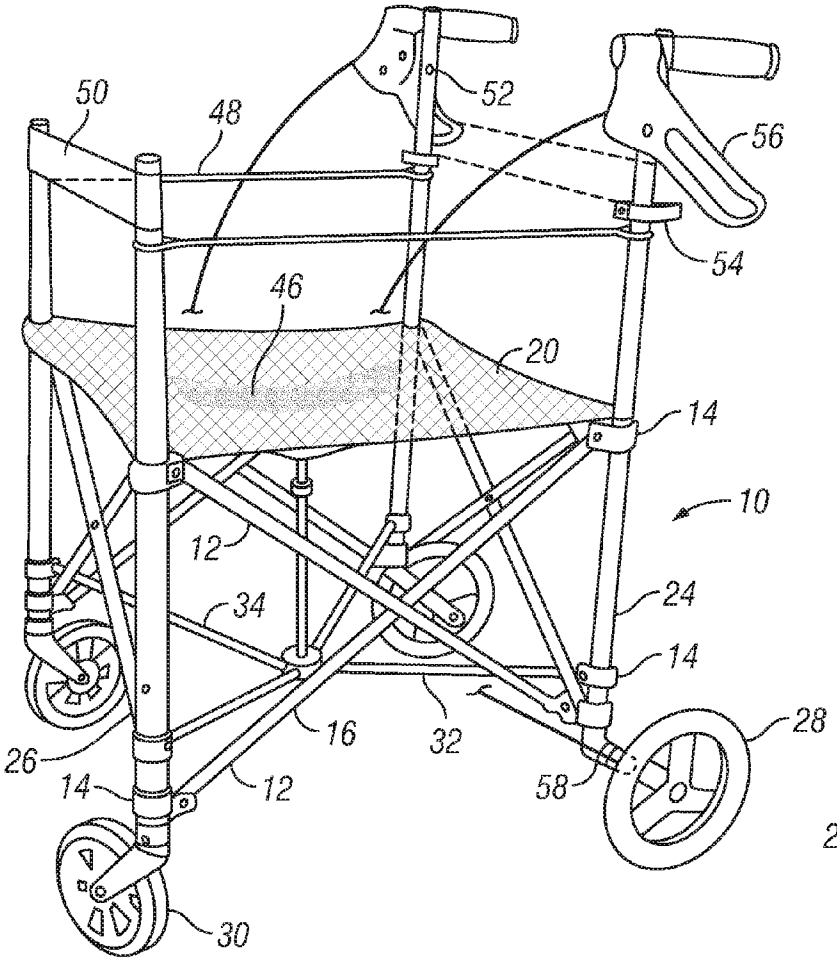
FIG. 1 is a perspective view of a support and shopping walker of this invention in its open state.
Figure 3:
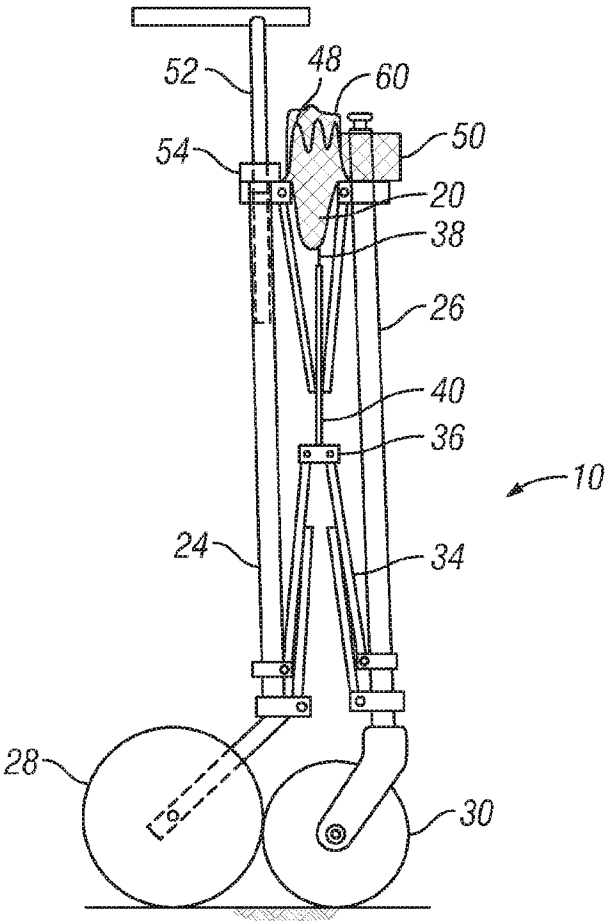
FIG. 3 is a side elevation view of the support and shopping walker in its collapsed state.
Figure 6:
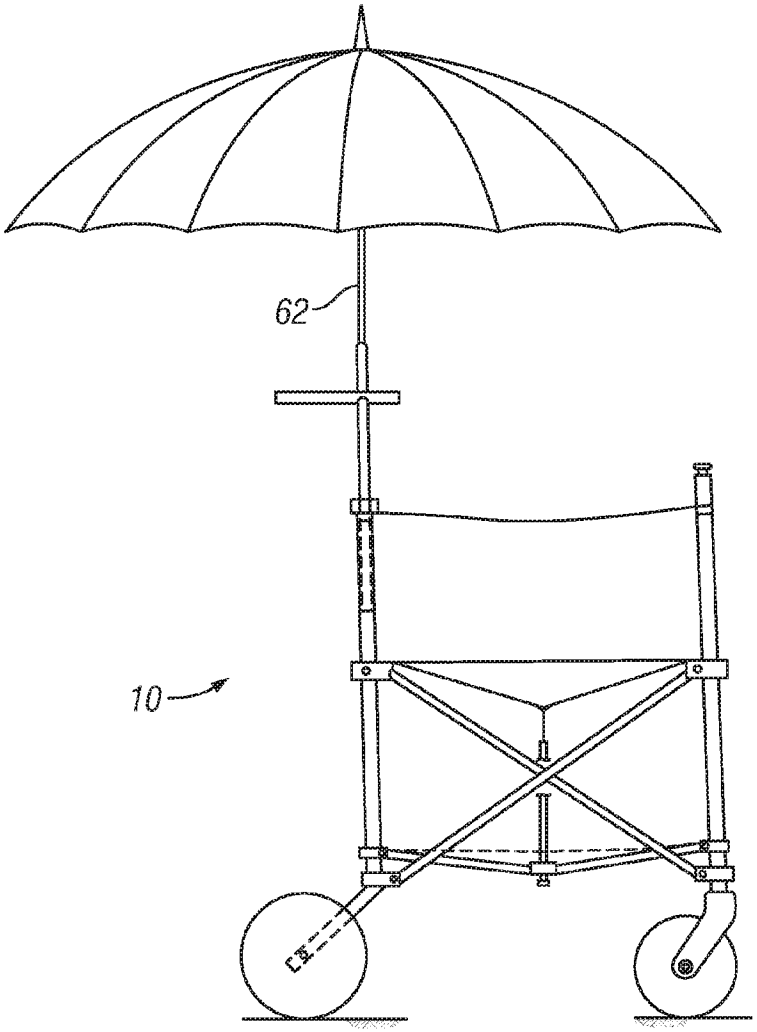
FIG. 6 is a side elevation view of the walker supporting a large golf type umbrella.
Figure 5:
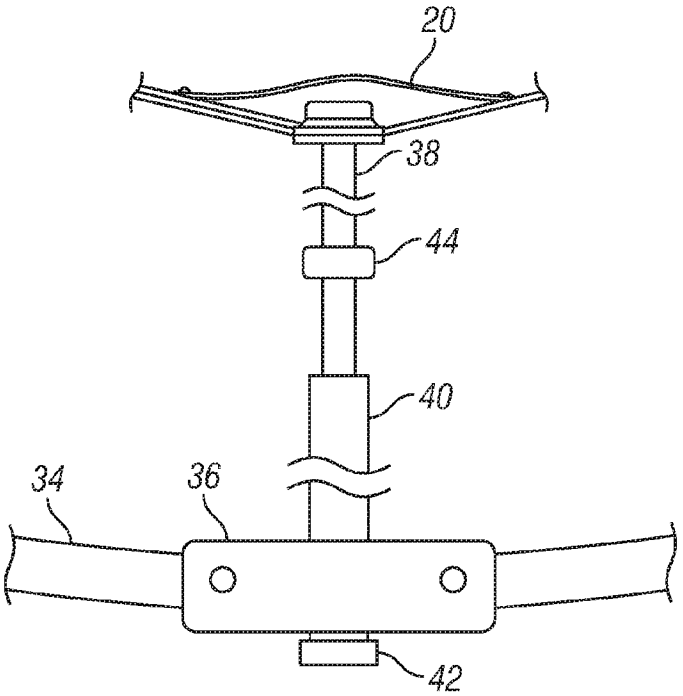
FIG. 5 is a side elevation view of the walker seat connection to the spider.

The novelty of the arrangement is created by installing four straight vertical tubes or legs 24, 26 as shown in FIGS. 1, 2 and 3 with wheels 28 and casters 30 at their lower end, as used in a conventional walker. However, using just this configuration as a walker on uneven surfaces makes it unstable since there are no diagonal supports between the four corners of the cage. Collapsible diagonal supports 32 made of four aluminum members of equal length, hinged at each end, form a four-legged array or "spider" 34. This arrangement provides for easy opening and closing of the cage by moving the central spider head 36 up and down like an umbrella.

In order to provide a stable chair or walker the spider must be lockable with the seat in the open position. This is arranged by letting the spider over toggle or go over its opening tipping point (FIG. 2) which stretches the fabric fully and tightens all the joints of the chair. However, the over toggle of the spider must be restricted since the cage otherwise will start to collapse again. This restriction is made by attaching a rod 38 to the underside of the center of the seat (fabric) 20. The rod can travel freely inside a tube 40 that is attached to the spider head 36 allowing it to be pushed down past the tipping point of the spider 34. The over toggle is facilitated by pressing the center of the seat (fabric) 20 down, which includes the rod 38, onto the upper end of the tube 40 which subsequently lets the spider head 36 snap to the bottom head 42 of the rod 38, into the predetermined inverted position. A suitable adjustable restriction 44 is placed on the upper part of the rod 38. At this moment all the forces in the structure are at equilibrium and they will remain so also when the seat is fully loaded by the user sitting down.

Closing the walker or chair is done by pulling up a strap handle 46 attached to the inside center of the fabric seat 20 which thus pulls up the spider head 36 beyond the toggle or tipping point. Further pulling then folds the spider and subsequently the cage together into compact bundle of aluminum tubes. The fabric armrests 48 and backrest 50 follow simultaneously.

Adjustable telescoping handles 52 are secured at any desirable height by bicycle type seat clamps 54. The handles are equipped with normal walker type wheel brake grips 56 and brakes 58 at the rear wheels 28. The swivel type caster 30 in the front completes the arrangement into a fully usable equipped walker.

The vertical tubes 26 supporting the casters 30 including the arm and backrest may be equipped with telescopic tubes that can follow the opening and closing of the cage. In the chair position they can nearly totally disappear or be pulled out and secured by clamps in any position. This results in adjustable heights for the arm and backrest and/or holding the shopping basket fabric in the right position.

Figure 4:
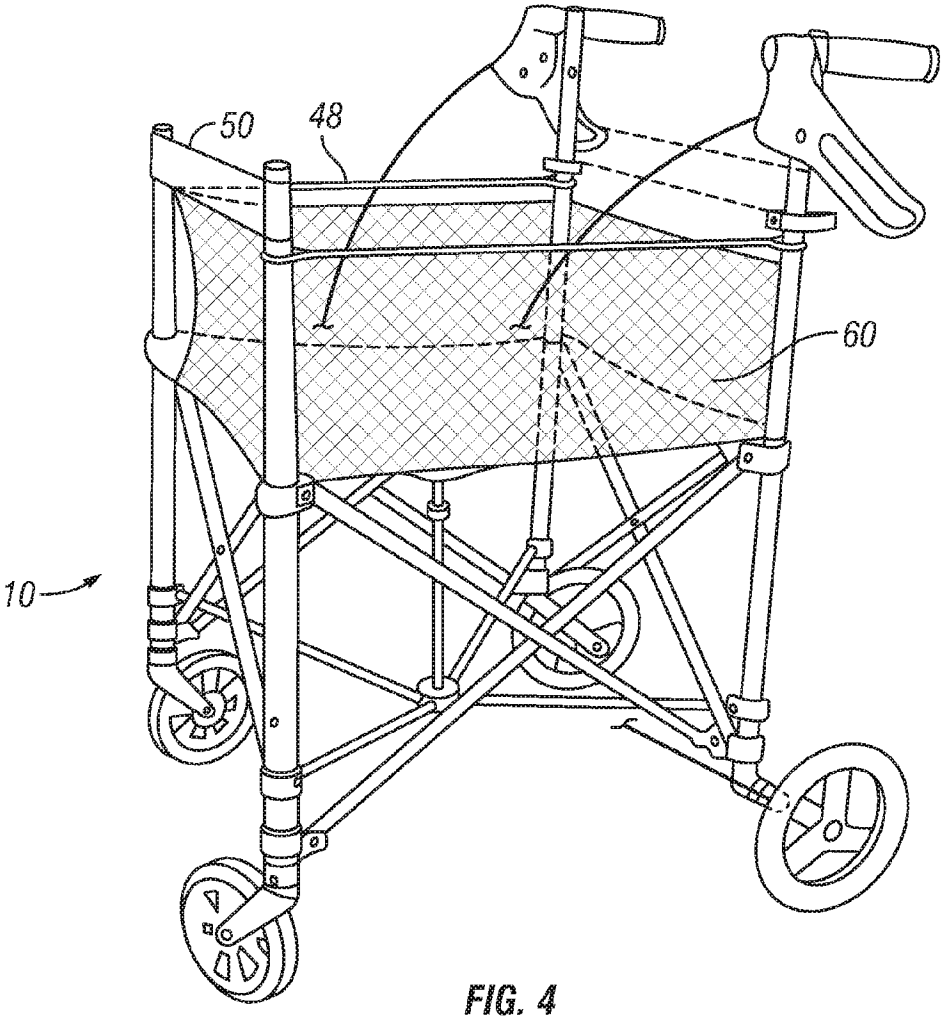
FIG. 4 is a perspective view of the walker in its shopping cart configuration.

Shopping Walker: The size and arrangement of the seat lends itself for further improvements. FIG. 4 shows how a suitable collapsible netting 60 surrounds the seat transforming the walker into a small flexible collapsible shopping cart.

Rain/Sun Protection: The vertical tube of one walker handle can without any modifications also support a large golf type umbrella 62, which serves as sun or rain cover, see FIG. 6.

Accordingly, one embodiment of the present invention may be characterized as a collapsible support walker, including four legs connected together at corner supports by four sets of pivotable cross braces to form a collapsible walker structure; four supports hinged together at a center head and each hingedly attached to a corner support of the walker structure thereby forming an array; where the array can be over toggled past a tipping point to lock the walker structure open against the tension of a flexible seat spanning the walker structure; wherein the array is restricted from collapsing upon being over toggled by attachment to a rod that is in turn attached to a bottom of said seat.

Another embodiment of the present invention may be characterized as a collapsible support walker, including four supports hinged together at a head and each hingedly attached to a corner support of the walker structure thereby forming a "spider"; where the spider can be over toggled past a tipping point to lock the structure of the walker open against the tension of a flexible fabric seat; where the spider is restricted from collapsing upon being over toggled by attachment to a rod that is in turn attached to a bottom of the fabric seat, which includes a strap handle for pulling up on the seat when it is desired to collapse the walker; and where collapsible netting can be added around the walker structure to transform the walker into a collapsible shopping cart.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A collapsible support walker comprising:

four legs connected together at upper and lower corner supports by four sets of pivotable cross braces to form a collapsible walker structure;

four diagonal supports hinged together at a center head and each hingedly attached to a lower corner support of said walker structure thereby forming an array; where said array can be over toggled past a tipping point to lock said walker structure open against the tension of a flexible seat connected to four upper corner supports and spanning the walker structure; wherein said array is restricted from collapsing upon being over toggled by attachment to a tube containing a movable rod that is in turn attached to a bottom of said seat.

2. The collapsible support walker of claim 1 wherein said flexible seat includes a strap handle for pulling up on said seat when it is desired to collapse the walker.

3. The collapsible support walker of claim 1 wherein collapsible netting is placed around said walker structure to form a collapsible shopping cart.

4. The collapsible support walker of claim 1 wherein one of said legs supports a removable umbrella.

* * * * *